United States Patent [19]

Winebarger

[11] Patent Number: 4,979,446

[45] Date of Patent: Dec. 25, 1990

[54] CORRUGATED PALLET

[76] Inventor: Ken N. Winebarger, 2007 Woodbriar Loop, South, Lakeland, Fla. 33813

[21] Appl. No.: 321,022

[22] Filed: Mar. 9, 1989

[51] Int. Cl.[5] ..... B65D 19/00

[52] U.S. Cl. ..... 108/51.3; 108/56.1

[58] Field of Search ..... 108/51.3, 56.1, 51.1; 411/504; 706/599, 600

[56] References Cited

U.S. PATENT DOCUMENTS

| | | | |
|---|---|---|---|
| 2,446,914 | 8/1948 | Fallert et al. . | |
| 2,709,559 | 5/1955 | Geisler | 108/51.3 |
| 2,728,545 | 12/1955 | Hermitage . | |
| 2,925,947 | 2/1960 | Brown | 108/51.3 X |
| 3,026,078 | 3/1962 | Simkins | 108/51.3 |
| 3,131,656 | 5/1964 | Houle . | |
| 3,464,371 | 9/1969 | Gifford | 108/51.3 |
| 3,477,395 | 11/1969 | Brown et al. . | |
| 3,666,165 | 5/1972 | Osborne et al. | 108/51.3 X |
| 3,683,822 | 8/1972 | Roberts et al. . | |
| 3,913,154 | 10/1975 | Sweeney . | |
| 3,927,624 | 12/1975 | Hewson | 108/56.1 |
| 3,940,101 | 2/1976 | Heidelbach . | |

OTHER PUBLICATIONS

Corpal Pallet System of Corpal System, Inc., Jacksonville, FL.

*Primary Examiner*—José V. Chen

*Attorney, Agent, or Firm*—Warren L. Franz

[57] ABSTRACT

A pallet of corrugated fiberboard material has floor-contacting spaced, parallel and longitudinal extending base members perpendicularly interconnected at longitudinally spaced intervals by floor-contacting spaced, parallel and laterally extending deck members. One or both of the base and deck members has perpendicular cutouts with horizontally extending cuts backed up for fork tine lifting purposes by unbroken horizontally extending panels. Each member is constructed from creased and scored rectangular blanks folded to comprise a solid core of adjacent vertically oriented panels surrounded by an outer covering of perimetric horizontally and vertically running panels.

7 Claims, 4 Drawing Sheets

CORRUGATED PALLET

This invention relates in general to a pallet of corrugated material; and, more specifically, to a corrugated pallet having superior strength and break resistance.

BACKGROUND OF THE INVENTION

Pallets are widely used in the transportation and storage of goods, The goods (typically packaged in boxes or bags) are stacked on the pallet and bound thereto by straps or wrapping for shipment therewith as an integral unit. Loaded pallets are stored in warehouses either on the floor or in racks in adjacent single or multiple level layers.

Conventional pallets are usually made of wood. Wooden pallets offer good materials handling and stacking strength characteristics. The decreasing supply of readily available wood is raising the cost of such pallets, however, and such wooden pallets are heavy and bulky to transport.

The use of pallets made of corrugated paperboard and similar materials as a substitute for wooden pallets has gained limited acceptance for some applications. Such corrugated pallets are lightweight, relatively maintenance free and readily disposable or recyclable. They may be transported and stored in unassembled form for maximum space utilization when unloaded, and assembled on-site for loading. After usage, they can be broken down for disposal or recycling just like cardboard boxes and other corrugated products.

One kind of known corrugated pallet is illustrated by the structures shown in U.S. Pat. Nos. 2,446,914; 2,728,545; 3,464,371; and 3,477,395. Such pallets comprise a plurality of longitudinally extending elongated base members or stringers held in parallel, spaced relation by means of top and bottom rectangular decking sheets to form skids with open channels into which the tines of forklifts can be inserted for materials handling purposes. Other versions of such pallets, as shown in U.S. Pat. Nos. 3,131,856 and 3,683,822, add a degree of lateral stability by providing a plurality of laterally extending, parallel, spaced deck members or cross runners perpendicularly interconnecting the base members at axially spaced intervals to form a rectangular lattice structure. The deck members span the base members in elevated positions without floor contact between the base members leaving the fork channels unobstructed.

Though known corrugated pallets provide lightweight, inexpensive alternatives to conventional wooden pallets for some applications, their strength and rigidity under both static and dynamic loading is insufficient to permit widespread general usage for all types and distributions of goods. Base member constructions, such as shown in the '371 and '395 patents having wrapped, adjacent side-by-side thicknesses of fluted fiberboard material placed in vertical direction of corrugation, are not known to have been employed in crisscross lattice type pallet structures such as shown in the '656 and '822 patents. Rather, the latter type corrugated pallets having perpendicularly interconnecting base and deck members have generally been formed from weak, relatively open core, support members. The skid type structures have no lateral support members at all; and the lateral members of the lattice type structures of not contact the floor between longitudinal members, so provide only suspension lateral weight supporting capabilities. Structures, such as the lattice shown in the '822 patent, are moreover prone to rocking instability, with the elevated cross ties being able to pivot out of the base members under dynamic loading.

No knows self-supporting pallet structures make adequate accommodation for four-way forklift tine entry into the pallet. The skid types represented by the '914, '545, '371 and '395 pallets, provide only two-way, front and rear entry into the spaced between the base members framed by the top and bottom sheets. The lattice types represented by the '656 and '822 patents provide the same two-way entry between the base members in the area below the deck members and, in addition, provide optional four-way access by means of cutouts or "pockets" made at floor level in the deck member (see, e.g., the pallets of Corpal Systems, Inc., Jacksonville, Fla.). Four-way entry is also provided in related but contained non-freestanding structures, such as shown in U.S. Pat. No. 3,666,165. However, such inherently weak, open core member structures lack strength at critical points and are subject to ripping at cuts made for fork tine insertion if the carried goods exceed the weight of cushions, textiles and similar light loads.

The strongest known corrugated pallets today have a load rating for a 4'×4' pallet of only 6,000–8,000 pounds under static loading. Such figures are only for careful uniform stacking of concrete blocks, however, and only for two-way addressable pallets. Under actual road transportation and warehouse stacking conditions, the strength of such pallets is considerably less. And, adding cutouts for four-way fork tine entry reduced the maximum strength load-carrying capability further.

SUMMARY OF THE INVENTION

It is an object to the present invention to provide a corrugated pallet having superior strength and break resistance under both static and dynamic loading.

In one aspect of the invention, a pallet is provided having a plurality of spaced parallel and longitudinally extending base member interconnected by a plurality of spaced parallel and laterally extending, floor contacting deck members to form a superior weight-supporting, freestanding lattice structure. In another aspect of the invention, a pallet is provided giving two- or four-way fork tine access through strengthened floor contacting members having cutouts backed up by unbroken elevated portions of the same.

In a preferred embodiment, described in detail below, a corrugated pallet is formed from base and deck members each having a solid core of adjacent vertically oriented panels surrounded by an unbroken outer cover of perimetrically running panels. Each member is formed from a single, rectangular blank of corrugated material divided into adjacent rectangular panels which are folded along crease and score lines laid perpendicular to the direction of corrugation. Tests conducted using concrete blocks have shown that a pallet in accordance with the invention is approximately three to four times stronger than same sized corrugated pallets such as those disclosed in U.S. Pat. No. 3,683,822. The members have cutouts to provide tine admitting openings and are folded to provide unbroken horizontal panel surfaces in alignment with horizontally disposed cuts of the cutouts. The resulting structure provides good weight-supporting and materials handling capabilities with tested weight stacking capability and break resistance approaching that of pallets made from soft wood.

BRIEF DESCRIPTION OF THE DRAWINGS

Embodiments of the invention have been chosen for purposes of illustration and description, and are shown in the accompanying drawings wherein.

Throughout the drawings, like elements are referred to by like numerals.

DESCRIPTION OF THE PREFERRED EMBODIMENTS

Figures 1, 3:
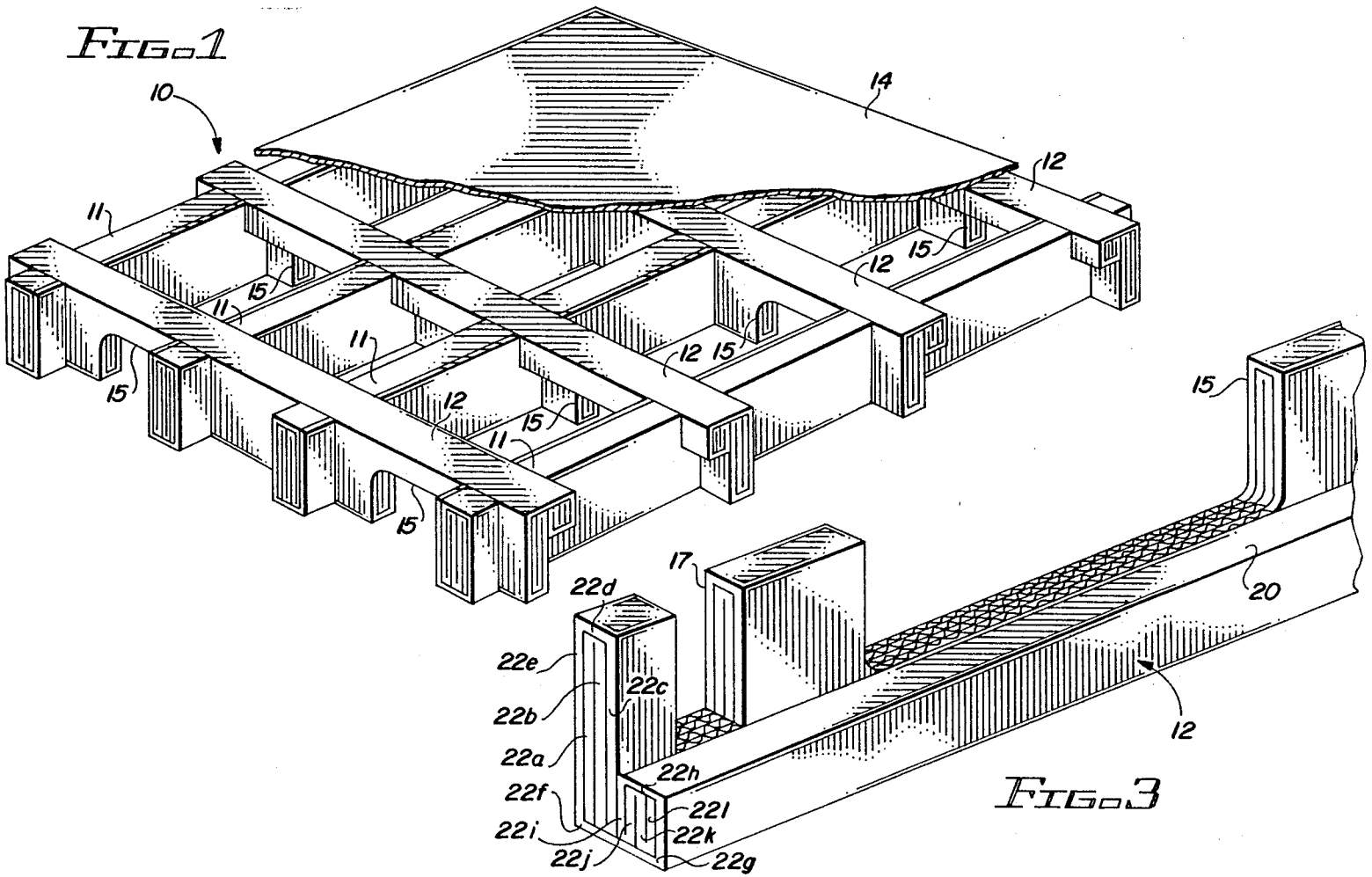
FIG. 1 is a perspective view, partially cut away, of a corrugated pallet in accordance with the present invention.
FIG. 3 is a perspective view showing the underside of the deck member of FIG. 2.

As shown in FIG. 1, an embodiment 10 of a pallet in accordance with the present invention comprises a plurality of elongated base member or stringers 11 laid in parallel, spaced positions longitudinally of the pallet 10 and interconnected in criss-cross fashion to form a free-standing weight-supporting lattice structure by a plurality of elongated deck members or cross runners 12 laid in parallel, spaced positions laterally of the pallet 10 to respectively perpendicularly intersect the members 11 at axially displaced positions therealong. The shown embodiment 10 utilizes four base member 11 and four decking member 12, though it is, of course, possible to utilize a fewer or greater number of such members, if desired.

The top surfaces of the members 11 and 12 are located in a common horizontal plane to provide a level upper platform for stacking goods (not shown) thereon. An optional top sheet or deck 14 (shown in cutaway) may be applied to the top surfaces to cover the interstices of the underlying lattice framework. The bottom surfaces of the members 11 and 12 are likewise coplanar to provide a stable, floor-contacting base for the pallet 10. The lateral members 12 are each provided with aligned cutouts 15 to provide longitudinal channels between the floor and the pallet structure 10 for two-way (front or rear) access thereinto for pallet lifting purposes by the tines of a forklift or like materials handling apparatus.

The members 11 and 12 and the top sheet 14 are all constructed of corrugated paperboard, plastic, or similar material. As shown in FIGS. 2–5, each member has a solid core of adjacent vertically stacked rectangular panels oriented with their corrugations running vertically and an outer covering or sheath or perimetrically placed rectangular panels of the same material alternately running horizontally and vertically around the core panels. The members 11 and 12 are unbroken except at their points of intersection and at the forklift tine cutouts 15.

The members 11 and 12 are interconnected at their points of intersection by locking and linking joints, in which a protuberance or void of one member mates in close tolerance relationship with a complementary protuberance or void of an intersected member. The joints should impart sufficient rigidity to the intersection to maintain a fixed relationship between them under longitudinal, lateral and axial rotational forces to be experienced during normal loaded pallet handling.

Figure 2:
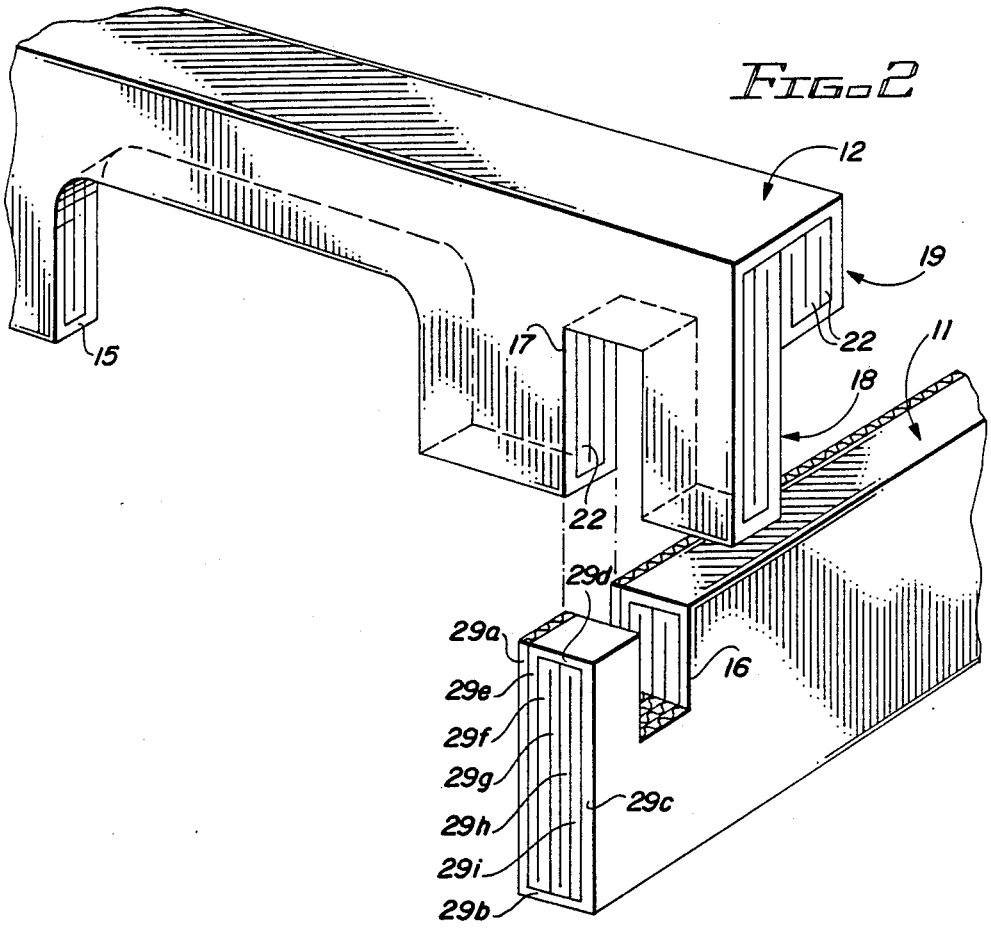
FIG. 2 is an enlarged fragmentary perspective view of a base member and a deck member of FIG. 1, showing their manner of interlocking.

A preferred means of interconnecting members 11 and 12 is shown in FIG. 2. Members 11 are provided with upwardly-facing U-shaped rectangular notches 16 having spaced vertical walls ascending from opposite edges of an interior horizontal wall. Members 12 are provided with similar downwardly-facing U-shaped notches 17. The notches 16 and 17 are oriented perpendicularly to the elongation of the respective members 11 and 12, with the width (distance between opposite walls) of notches 16 being slightly less than the width (dimension perpendicular to the elongation) of the opposing member 12, and the width of notches 17 being slightly less than the width of the opposing member 11. To provide the level top and bottom surfaces, the vertical dimensions of the longitudinal members 11 and lateral members 12 are made equal, and the depths (vertical dimensions) of the cuts 16 and 17 are selected so that the interior horizontal wall of the notch 17 is at the same elevation as the top (lifting) surface of the cutout 15 and the sum of the depths of the notches 16 and 17 is equal to the vertical dimension of each member 11, 12.

Figure 4:
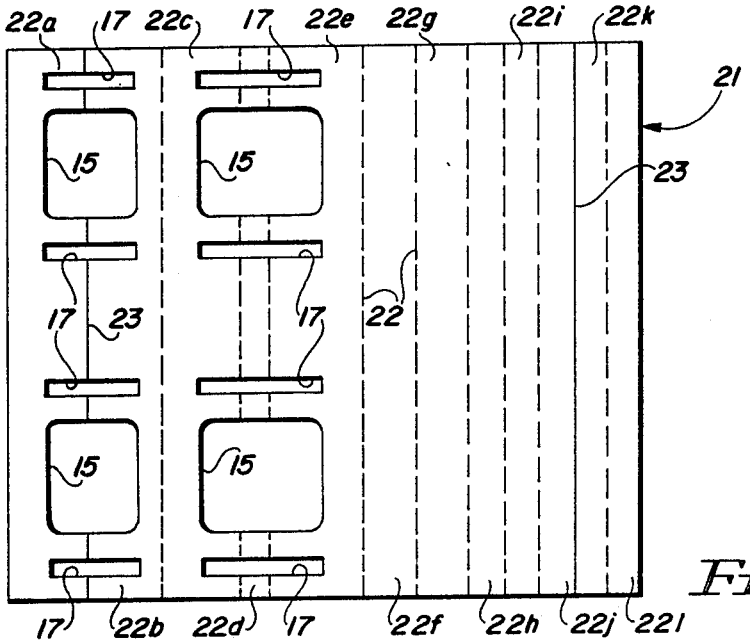
FIG. 4 is a front plan view of a blank suitable for forming the deck member of FIGS. 2–3.

As shown in FIGS. 2–4, each of the deck members 12 has a first rectangular cross-section portion 18 extending the full height (vertical dimension) of the pallet 10 and a second rectangular portion 19 flush with the top of the pallet 10 but extending only partway to floor level. The rectangular cutouts 15 and notches 17 extend only through the first portion 18 of the member 12 from floor level to a height which is flush with the bottom of an unbroken bottom panel of the second portion 19. This arrangement is best seen in FIG. 3 which shows the underside of the member 12. The purpose of such configuration is to provide an unbroken surface 20 on the portion 19 against which tines passing through the cutouts 15 can be brought. A portion of the horizontal wall of the notches 16 which is brought up through the notches 17 will also abut the surface 20. It has been observed that this unbroken surface backup feature greatly reduces breakage, such as the diagonal tearing at the inside corners of cutouts 15 that can occur when the pallet 10 is subjected to tine lifting under heavy loading. The same also resists ripping and distortion of the panel 10 in the area of the cutouts 15 when strapping is run therethrough for bundling goods on the pallet 10.

FIG. 4 shows a sheet or blank 21 of corrugated material suitable for use in forming the deck members 12 of the pallet 10. The blank 21 is arranged with the corrugations running from left to right perpendicular to the right- and left-hand edges of the sheet. The blank 21 is divided into adjacent parallel rectangular panels 22 (22*a*–22*l*), as shown, by crease lines 23 (dashed lines) and score lines 24 (solid lines) normal to the direction of corrugation. The crease and score lines may be created by die cutting or sawing partway through the material, with crease and score line cuts being done on opposite faces of the blank 21. To create the member 12, the blank 21 is folded, bringing adjacent panel front faces toward each other about crease lines 23 and taking them away from each other about score lines 24. The cutouts 15 and 17 are made as by die cuts in panels 22a–22e, as shown, to be properly positioned in the folded member 12.

The panels 22a–22e of portion 18 and 22g–22l of portion 19 are separately folded onto the panel 22f, so that the end panels 22a and 22l are each interiorly placed in the core sections of their respective portions 18 and 19 in the finished structure. The fixed relationship of the panels is secured in knows ways, such as by gluing or stapling. The finished member 12 comprises a closely packed core of adjacent vertically stacked panels 22a–b, 22c (upper portion) and 22i–22 l surrounded by an outer covering or wrap of perimetrically placed panels 22c (lower portion), 22d, 22e, 22f, 22g and 22h. Panels 22a–c, 22e, 22g, and 22i–22l all have their corrugations oriented in the vertical direction to provide the greatest downward load bearing strength to the assembled pallet 10. Only panels 22d, 22f and 22h are horizontally oriented, and only one of those panels (i.e. panel 22d which serves as the floor contacting bottom surface is cut to establish the tine cutouts 15 and the joint notches 17. (Though the preferred cutouts 15 are open to the floor because the tines are often lowered to scrape along the floor prior to lifting, it will be appreciated that cutting of panel 22d at the locations of cutouts 15 is not a requirement.) For the vertical panels, transverse cutting of the fluting occurs only in the panels 22a, 22b, 22c and 22e. The panels 22g and 22f–22l remain intact. The horizontal panel 22h provides the unbroken surface 20 to give integrity for backing up the lifting portions of the cutouts 15 and 17. The unbroken horizontal panel 22f provides the top surface or deck for stacking the goods. It is noted that horizontal surface 22d of each lateral member 12 will contact the floor providing vertical weight support to the deck at all locations, except the cutouts 15 and notches 17.

Figure 5:
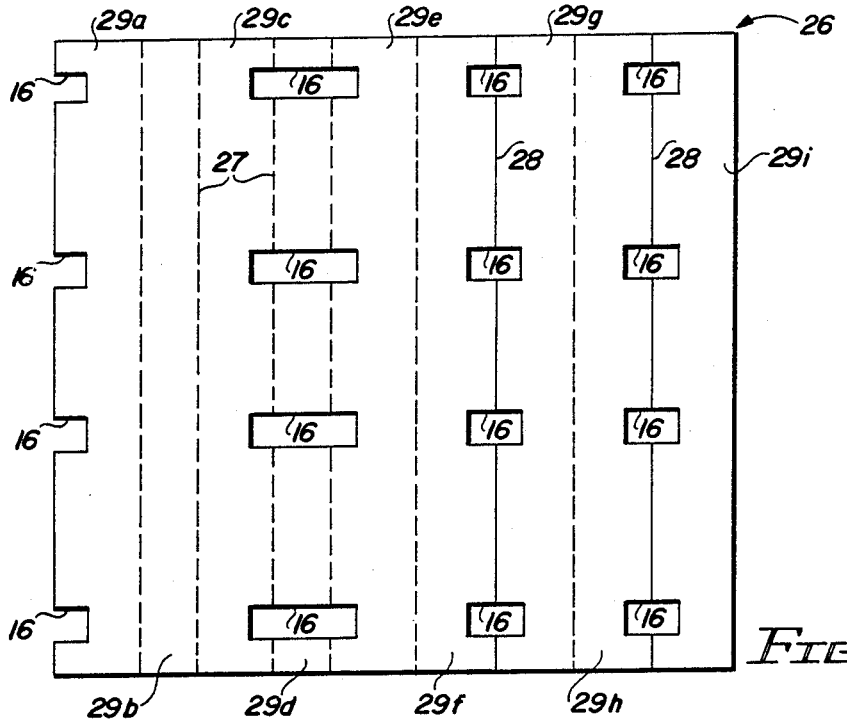
FIG. 5 is a front plan view of a blank suitable for forming a base member of FIG. 1.

The base member 11 is suitably formed from a planar blank by folding similar to that described above for folding the blank 21 to create member 12, except there are no fork tine cutouts. With reference to FIG. 5, a rectangular blank 26 for member 11 has corrugations running from left to right, parallel with the upper and lower edges of the blank, but perpendicular to crease and score lines 27, 28 shown, respectively, by dashed and solid lines, which divide the blank 26 into adjacent rectangular panels 29 (29a–29i). Cutouts 16 are die cut or otherwise formed in the blank 26, as indicated, to provide their proper location in the folder member. Folding is begun from the panel 29i end, bringing adjacent panel faces toward each other at crease lines 27 and away from each other at score lines 28. The finished folder structure 11 (see FIG. 2) has a closely packed core of adjacent vertically stacked panels 29e–29i wrapped by an outer covering of perimetrically placed, alternating horizontally and vertically disposed panels 29a–29d. All panels 29, except panels 29b and 29d, have their corrugations oriented in the vertical direction for greatest weight-supporting capacity.

The illustrated creasing and scoring arrangement enables the longitudinally extending, exposed fluting right edge of the right end panel 29i to be located interiorly of the folded member 11. Except for the upper and lower edges of the blank 26 which form the end of the elongated member 11 in the folded structure, exposed fluting thus occurs only at the left edge of the left end panel 29a and the cutout portions of the panels 29a, 29c–29i which form the notches 16.

In the assembled pallet 10, all exposed fluting of member 11 is concealed, except the left edge of panel 29a. For the member 12, all exposed fluting, except at cutouts 15, will be concealed. The dimensioning of the notches 16, 17 of the members 11 and 12 provides a tight interlock between the members 11 and 12 which can be performed on-site, just before pallet use, and reinforced by gluing or other common joint securing techniques.

The embodiment 10 of pallet shown in FIGS. 1–4 constitutes a two-way entry version of corrugated pallet with the aligned cutouts 15 on the member 12 providing a pair of parallel channels extending longitudinally through the pallet and providing both front and rear access to apply forklift tines for lifting the loaded pallet. The unbroken horizontal panels 22h of the members 12 provide integral lifting surfaces 20 flush with the horizontally disposed interior wall of the cutouts 15 against which the tines act during lifting. These surfaces back up the exposed fluting parts of the cutouts 15 to increase the resistance of the pallet 10 to breakage and tearing by the tines.

Figure 6:
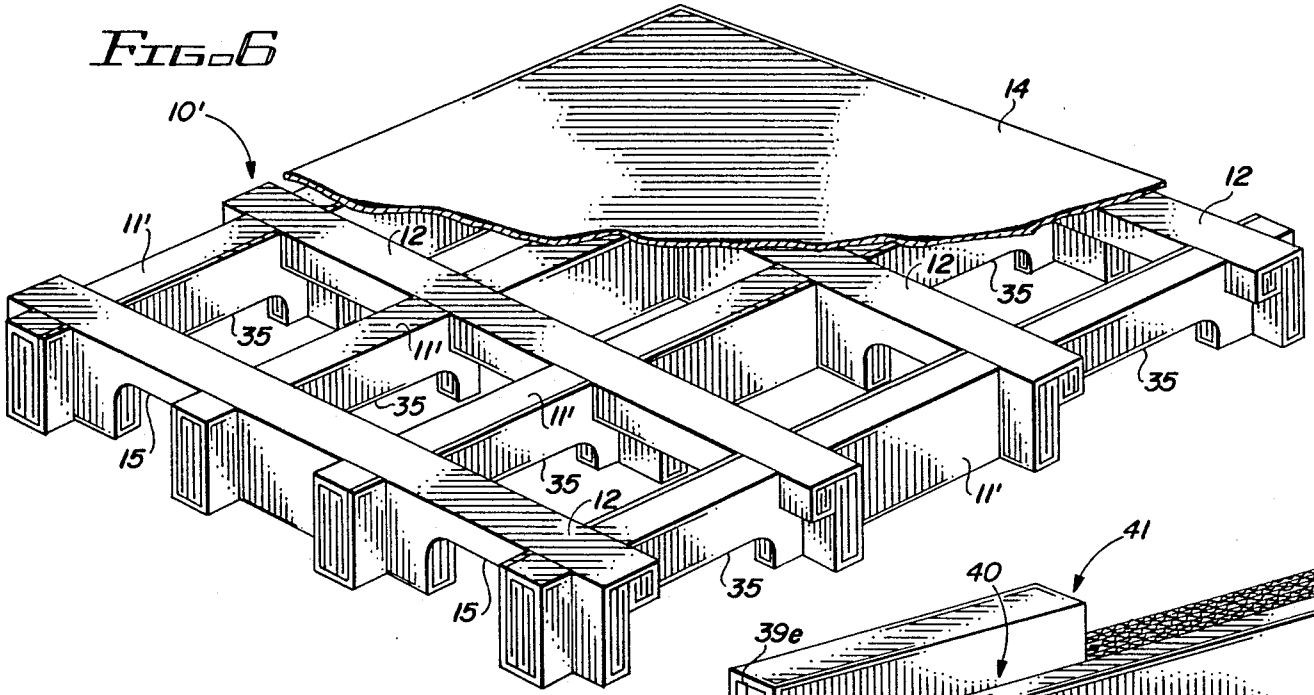
FIG. 6 is a view as in FIG. 1 of a modified embodiment of the invention.

A modified embodiment 10′ of the pallet in accordance with the invention is shown in FIG. 6. Pallet 10′ has a modified base member 11′ which gives the pallet a four-way tine access capability.

Figure 8:
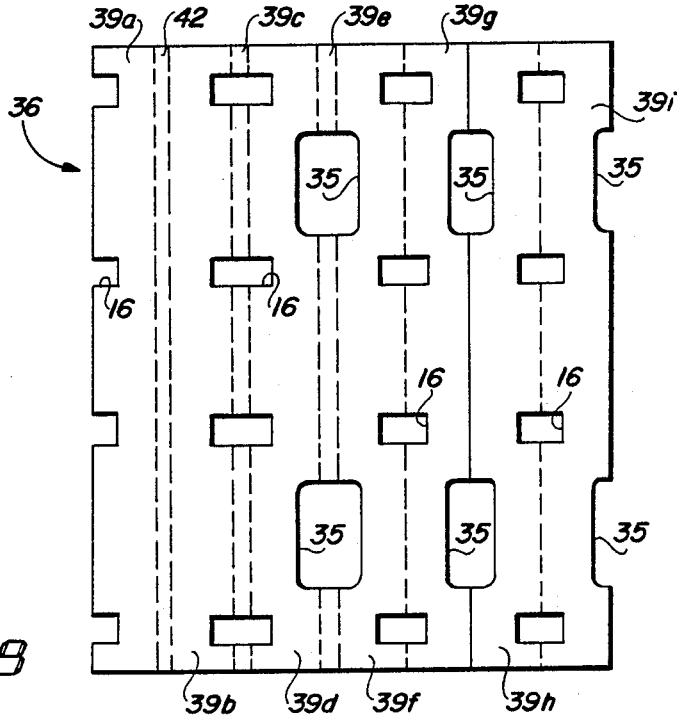
FIG. 8 is a front plan view of a blank suitable for forming the modified base member.
Figure 7:
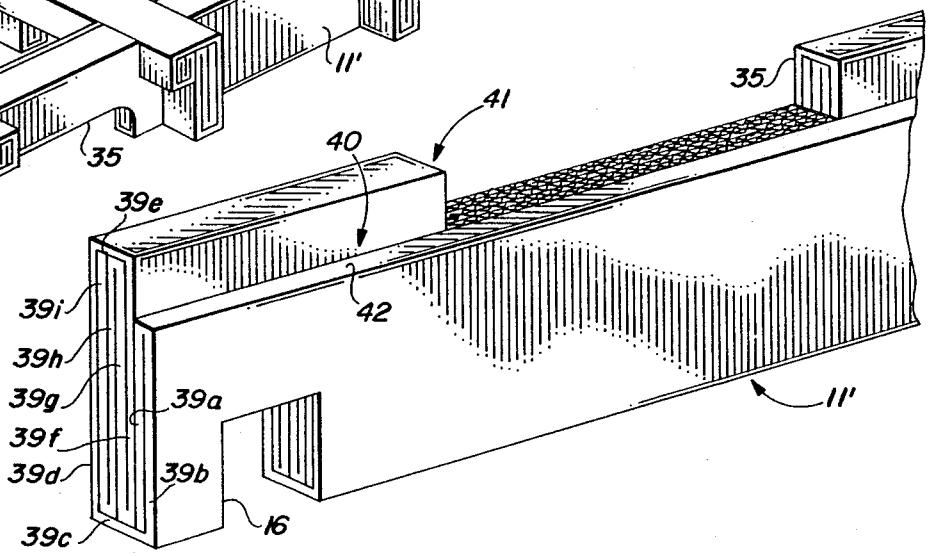
FIG. 7 is a perspective view showing the underside of a base member of the modified structure of FIG. 6.

FIGS. 7 and 8 are views showing the particulars of the construction of modified base member 11′. It will be seen that the longitudinal member 12′ is constructed in a two portion manner similar to the already described construction of base member 11 shown in FIGS. 3 and 4. A rectangular blank of corrugated material 36 (FIG. 8) having corrugations running from left to right is divided by creasing and scoring lines 37, 28 (as with the previously discussed blanks 21 and 26) into adjacent parallel rectangular panels 39 (39a–39i) which are folded toward each other on crease lines and away from each other on score lines to produce the folder and glue structure shown in FIG. 7.

In contrast to the base member 11 of FIGS. 1, 2, and 5, the base member 11′ is provided with a series of cutouts 35 to form laterally aligned tine receiving openings in the lattice of pallet 10′, as shown in FIG. 6. Panels 39a–39i are folded along the indicated lines to produce a longitudinal member having adjacent rectangular portions 40, 41, with the portion 40 being formed from panels 39a and 39b and, like the portion 19 of member 12, being uninterrupted at the tine channel cutout 35. The blank 36 is separately folded either simultaneously or sequentially from the panel 39a end and the 39j end to produce the portion 40 from panels 39a and 39b and the portion 41 from the panels 39d–39i. Both left and right exposed fluting edges of the blank 36 (i.e. the left edge of panel 39a and the right edge of panel 39j) are folded interiorly so that fluting is exposed only at the cutouts 35 and notches 17.

The panels 39a, 39f (upper portion), and 39g–39i make up the core of the member 11′; while the panels 39b–39e and 39f (lower portion) make up the outer wrap. All, except panels 39c and 39e, are vertically oriented with their corrugations running in the vertical direction for greatest strength. A rectangular section 42 intermediate a double fold line 37 between panels 39a and 39b provides an unbroken platform flush with the inside horizontal wall of the cutout 35 to provide backup support to the member 11′ by increasing the integrity of the structure adjacent the tine-receiving slot in the same way that surface 20 provides a platform to cooperate with the tine-receiving cutout 15.

In the illustrated embodiment of pallet 10', the depth (vertical dimension) of the cutout 35 is less than the depth of the cutout 15. This is to maximize pallet access under normal conditions while minimizing the cutout area on the longitudinal members. The cutouts 15 are made deeper to accommodate the higher floor-to-tine separation of heavy duty forklift equipment used at loading/unloading docks. Two-way, front/rear access will normally be sufficient for such high volume, full-loaded pallet moving chores. The cutouts 35 are, however, sufficiently deep to provide four-way access to accommodate the lower elevation tines of less rugged, pneumatic tine lift trolleys that are frequently used to shift pallets around on a low volume, pallet-by-pallet basis during warehousing and for movement of inventory. The smaller depth of cutout 35 and lesser two-ply width of the unbroken section 42 (relative to the five-ply width of surface 20 of panel **22*h***) is considered sufficient for this purpose.

Pallets produced in accordance with the above embodiments have withstood testing in excess of 10,000 pounds under both static and dynamic loading. In one example test, a 4'×4' pallet of the two-way entry type shown in FIG. 1, was tested to determine its performance under load, under conditions simulating a cross country journey in a truck trailer. The tester had a table which had a 1" throw and a 1" drop. Based on the amount of load, the tester was set at a speed and ran for a given period of time to simulate a trip of some specified miles.

The tested pallet was constructed of dual arch, A width, normal double walled BC flute corrugated paperboard, without a top sheet. The pallet was tested for 50 minutes supporting 2,520 pounds at 180 RPM's. This simulated a trip of about 5,000 miles under most difficult road conditions, during which the pallet was exposed to fore, aft and sideways swaying motions. The pallet in accordance with the invention not only survived, but appeared to be like new—never used—at the end of the test. Only a wooden pallet with bottom slats could have survived the test as well. All knows corrugated pallets would have fared very poorly or failed altogether under the same test.

In accordance with the invention, a superior strength pallet has been described by reference to preferred embodiments thereof, having particular advantages over corrugated pallets of the prior art, yet providing the same advantages of lighter weight and less cost than wood pallets. The stable configuration of the pallet allows for part of the pallet to experience damage without destroying the integrity and usability of the remaining portion. The pallet provides strong floor contacting, lateral weight-supporting members with minimal flute exposure, and structural reinforcement of all tine receiving openings.

Due to the unique design of the longitudinal and lateral members, a pallet in accordance with the invention can support a load while in a rack far in excess of conventional corrugated pallets. The design of the pallet provides for more supporting members to contact either the floor or the top of an underlying pallet load. This ensures greater weight distribution and, for stacked pallets, significantly reduces crushing or creasing of the load (in most instances boxes) so underlying pallets. Because the base and deck members support the load through contact with the floor in both the longitudinal and lateral members, the pallet in accordance with the invention can traverse most roller conveyor systems in any direction. Prior art pallets which have only longitudinal floor support are limited to movement in only one direction since the rollers must generally be oriented perpendicularly to the main supporting member in order to roll the pallet.

The pallet design provides for the ability of the pallet to absorb and withstand motion shock in all directions. By providing for interlocking members and having all supporting members contacting the floor, this pallet will not collapse because of any side motion pressure. Prior art pallets do not have this ability and are thus subject to failure when used to transport loads by truck or rail over long distances. The four-way entry version provides four-way entry while maintaining superior strength and break resistance not available in similar prior art constructions. User different size and strength requirements can be met without the need to vary the overall design. Changes in dimensions, weight and type of corrugated material utilized, etc., will not interfere with the basic performance characteristics. This is not the case for prior art units.

Those skilled in the art to which the invention relates will appreciate that the foregoing detailed embodiments serve merely to illustrate exemplary implementations of the invention and that various substitutions and modifications may be made to the same, without departing from the spirit and scope of the present invention as defined by the claims appended hereto.

I claim:

1. A pallet of corrugated material for the shipment and storage of a load of goods stacked thereon, and the like, comprising:

a plurality of spaced, parallel and longitudinally extending base members having horizontally extending lower surfaces; and a plurality of spaced, parallel and laterally extending deck members interconnecting said base members at longitudinally spaced intervals therealong and having horizontally extending lower surfaces which are coplanar with said lower surfaces of said deck members at least at portions of said deck members intermediate said base members;

the members of at least one of said pluralities of base and deck members having cutouts therein to present channels perpendicular to said members into which the tines of pallet lifting equipment can be inserted; and each of said members of said one of said pluralities being formed with first and second portions; said cutouts being in said first portions and defining lifting surfaces against which the tines inserted in said channels can act to lift said pallet; and said second portions being located adjacent to said first portions and defining backup surfaces of uncut corrugated material in alignment with said cutout lifting surfaces against which said tines can also act when they act against the cutout lifting surfaces during lifting of said pallet.

2. A pallet as in claim 1, wherein each of said base and deck members comprises a solid core of adjacent vertically oriented panels surrounded by an outer covering of perimetric horizontal and vertically running panels.

3. A pallet as in claim 2, wherein said vertically oriented and vertically running panels have vertically directed corrugations.

4. A pallet for the shipment and storage of a load of goods stacked thereon, and the like, comprising:

a plurality of spaced, parallel and longitudinally extending base members having horizontally extending lower surfaces; and a plurality of spaced, parallel and laterally extending deck members interconnecting said base members at longitudinally spaced intervals therealong and having horizontally extending lower surfaces which are coplanar with said lower surfaces of said deck members at least at portions of said deck members intermediate said base members;

wherein the members of at least one of said pluralities of base and deck members have cutouts therein to present channels perpendicular to said members into which the tines of pallet lifting equipment can be inserted; and wherein each of said base and deck members if formed from a single sheet of folded corrugated material, and each comprises a solid core of adjacent vertically oriented panels surrounded by an outer covering of perimetric horizontal and vertically running panels.

5. A pallet of corrugated material for the shipment and storage of a load of goods stacked thereon, comprising:

a plurality of elongated base members laid longitudinally in parallel, spaced positions; and a plurality of elongated deck members laid laterally in parallel, spaced positions and perpendicularly intersecting said base members at longitudinally displaced positions therealong to interconnect the same in criss-cross fashion to form a freestanding weight-supporting lattice structure;

said base and deck members each having top surfaces located in a common upper horizontal plane to provide a level upper platform, and bottom surfaces located in a common lower horizontal plane to provide a stable, floor-contacting base;

said deck members each being provided with laterally spaced cutouts intermediate said base members, with the cutouts of the respective deck members being aligned to provide longitudinally extending channels into which tines of pallet lifting equipment can be inserted; and said cutouts being formed by cutting said corrugation material to define intermediate surfaces located in a plane between said upper and lower planes and against which the inserted tines can act to lift said pallet, and said deck members further having uncut portions located longitudinally adjacent to said cutouts, said uncut portions defining backup surfaces of uncut corrugated material located in planar alignment with said intermediate surfaces against which the tines can also act when the act against the intermediate surfaces during lifting of said pallet.

6. A pallet as in claim 5, wherein each of said base and deck members comprises a solid core of adjacent vertically oriented panels surrounded by an outer covering of perimetric horizontal and vertically running panels, said vertically oriented and vertically running panels having vertically directed corrugations.

7. A pallet as in claim 5, wherein each of said deck and base members is formed from a single sheet of folded corrugated material.

* * * * *